US009021735B2

(12) United States Patent
Ervin

(10) Patent No.: US 9,021,735 B2
(45) Date of Patent: May 5, 2015

(54) BLACK POWDER PELLET LOADER FOR A REVOLVER

(71) Applicant: Todd Ervin, Lansing, MI (US)

(72) Inventor: Todd Ervin, Lansing, MI (US)

( * ) Notice: Subject to any disclaimer, the term of this patent is extended or adjusted under 35 U.S.C. 154(b) by 0 days.

(21) Appl. No.: 14/531,476

(22) Filed: Nov. 3, 2014

(65) Prior Publication Data

US 2015/0047245 A1 Feb. 19, 2015

Related U.S. Application Data

(63) Continuation-in-part of application No. 13/317,380, filed on Oct. 18, 2011.

(51) Int. Cl.
*F41A 9/85* (2006.01)
*F41C 27/00* (2006.01)

(52) U.S. Cl.
CPC ..... *F41C 27/00* (2013.01)

(58) Field of Classification Search
USPC ..... 42/51, 87, 89; 89/1.3; 124/82; 221/260, 221/268, 270, 310
See application file for complete search history.

(56) References Cited

U.S. PATENT DOCUMENTS

| | | | | | |
|---|---|---|---|---|---|
| 2,294,001 | A | * | 8/1942 | Ritter | 206/537 |
| 2,893,599 | A | * | 7/1959 | Kay | 221/260 |
| 3,263,664 | A | * | 8/1966 | Bauer et al. | 124/49 |
| 3,412,897 | A | * | 11/1968 | Slater | 221/226 |
| 3,783,545 | A | | 1/1974 | Sefried, II | |
| 3,854,625 | A | | 12/1974 | Kuebler | |
| 4,174,048 | A | | 11/1979 | Volpe, Jr. | |
| 4,831,998 | A | | 5/1989 | Maguire, III | |
| 5,182,412 | A | | 1/1993 | Mazza | |
| 6,637,143 | B1 | | 10/2003 | Wykle | |
| 7,451,563 | B1 | | 11/2008 | McKnight | |
| 7,954,480 | B2 | | 6/2011 | Broberg, Jr. | |
| 8,112,932 | B1 | | 2/2012 | Vollmer | |
| 8,291,894 | B2 | | 10/2012 | Barwick, Jr. | |
| 8,308,026 | B2 | | 11/2012 | Rapko et al. | |
| 2006/0123684 | A1 | | 6/2006 | Bunney | |

* cited by examiner

*Primary Examiner* — Gabriel Klein
(74) *Attorney, Agent, or Firm* — Maier & Maier, PLLC

(57) ABSTRACT

A black powder pellet loader for a revolver. Tip ends of a number of fingers are movable from a closed position to an open position by sliding a thumb bracket toward a main bottom right end tube. One end of a penetrating tube may penetrate through the second end of a sliding raised rib tube, through a reducer adapter and a finger retaining nut until the end of the penetrating tube strikes a downward bend of each of the fingers. The downward bend of the fingers may continue to slide over the penetrating tube, which may force the tip ends of the fingers diverge from the closed position to the open position. Black powder pellets may be inserted between the fingers when in the open position, and upon release of the thumb bracket may be retained in the fingers when in the closed position.

7 Claims, 2 Drawing Sheets

BLACK POWDER PELLET LOADER FOR A REVOLVER

RELATED APPLICATIONS

This application claims priority as a continuation-in-part to U.S. Non-Provisional application Ser. No. 13/317,380, filed Oct. 18, 2011, the entire contents of which are herein incorporated by reference.

BACKGROUND

Revolvers are a popular type of firearm. Different types of revolvers may utilize different types and sizes of ammunition. For example, black powder pellets may be used as ammunition in certain types of revolvers, and may come in different sizes such as .31, .36, .44, or .45 calibers.

Traditionally, black powder pellets are loaded into a revolver by gripping individual pellets between a user's fingers to insert into an individual chamber. This process requires a user to handle and load each pellet individually by hand into, for example, a five or six shot revolver. As a result the process is difficult and time consuming, and can result in lost or damaged pellets if a user drops the pellets during loading. Therefore, an easier, faster and more generally more efficient way to load black powder pellets into a revolver without waste is desirable.

SUMMARY

According to one exemplary embodiment, the present invention may disclose a black powder pellet loader for a revolver. The black powder pellet loader may include an end cap with an outside diameter and a receiving hole protruding from a center of the end cap. A shoulder may be formed on top of the receiving hole, which has inside and outside threads.

A main inner shaft with a first end may be received within the receiving hole of the end cap and coupled to the inside threads. A second end of the main inner shaft may be coupled to a first end of a penetrating tube. A compression spring may be received over the penetrating tube and main inner shaft such that a first end of the compression spring abuts the shoulder of the end cap.

A main bottom right end tube may be received over the main inner shaft, penetrating tube, and compression spring. A first end of the main bottom right end tube may be coupled to the outside threads of the receiving hole of the end cap, and a second end of the main bottom right end tube may be slidably engaged with a first end of a sliding raised rib tube. A thumb bracket may be received over the sliding raised rib tube, and may be held on the sliding raised rib tube by a snap ring.

A reducer adapter may be coupled at a first end to a second end of the sliding raised rib tube. A second end of the reducer adapter may be coupled to a first end of a finger retaining nut, the reducer adapter further having a hollow bore.

A first end of each of a plurality of fingers may be received through a second end of the finger retaining nut, and within a plurality of nubs spaced equidistantly on an interior circumference of the finger retaining nut. The plurality of fingers may each have a straight portion extending from the first end, and a downward bend proximate the tip end, such that the tip ends of the plurality of fingers converge.

BRIEF DESCRIPTIONS OF THE FIGURES

Figure 1:
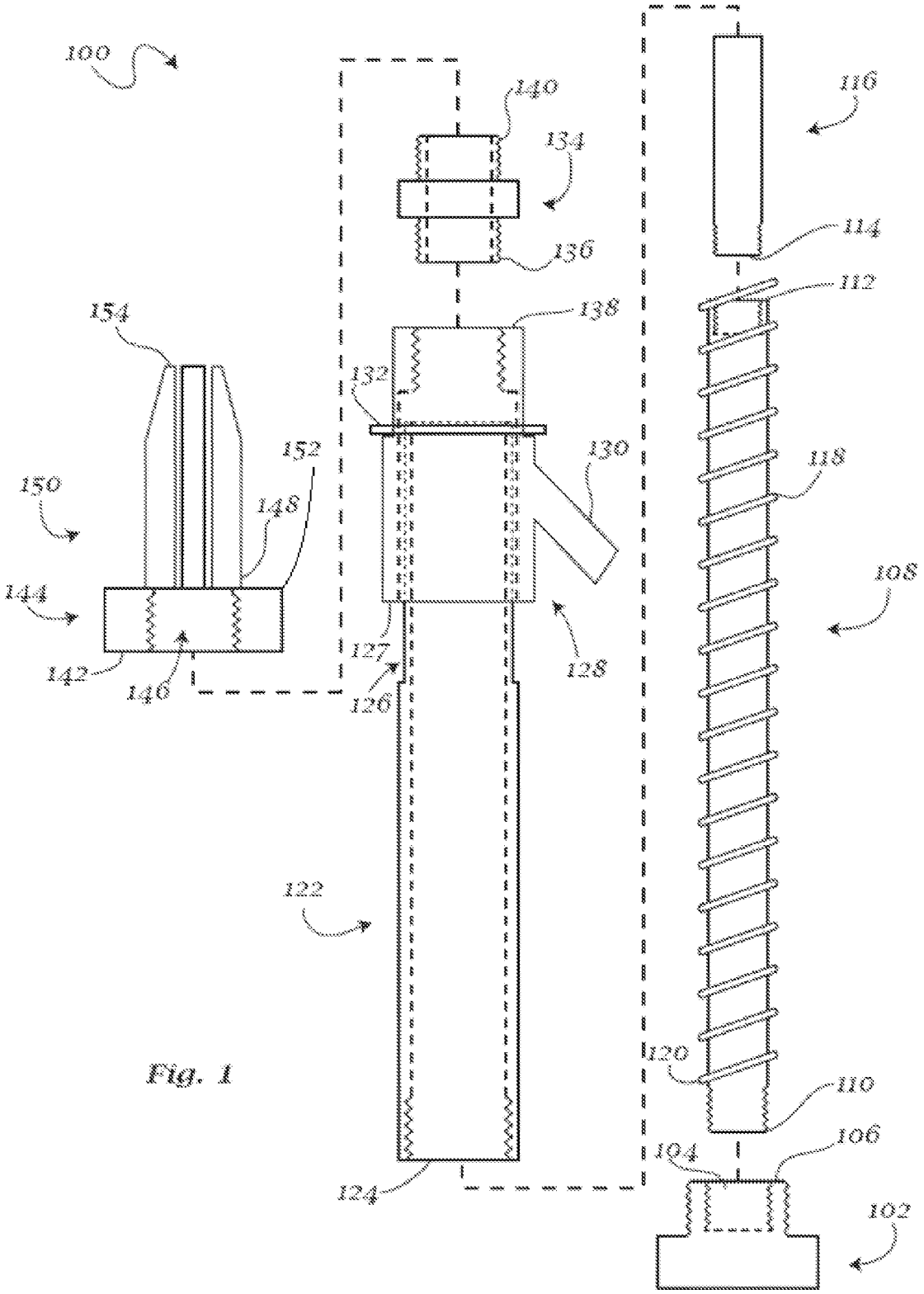

FIG. 1 may show an exemplary embodiment of an exploded view of a black powder pellet loader for a revolver.

Figure 2:
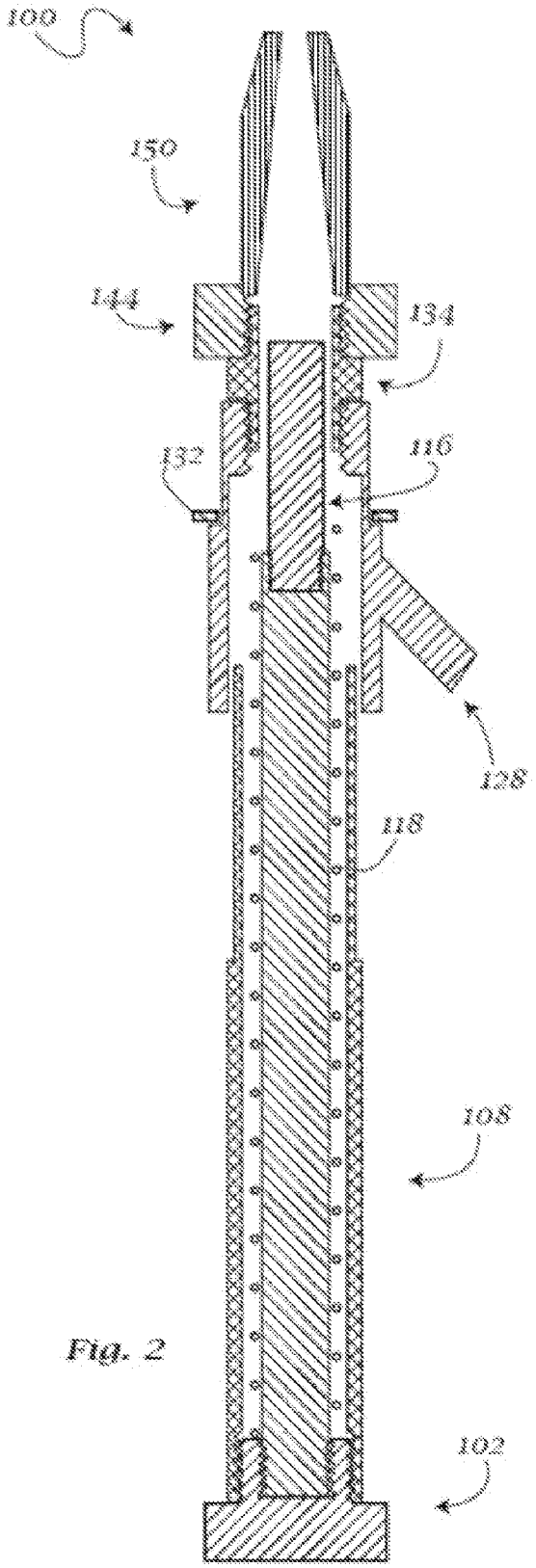

FIG. 2 may show an exemplary embodiment of an assembled view of a black powder pellet loader for a revolver.

Figure 3A:
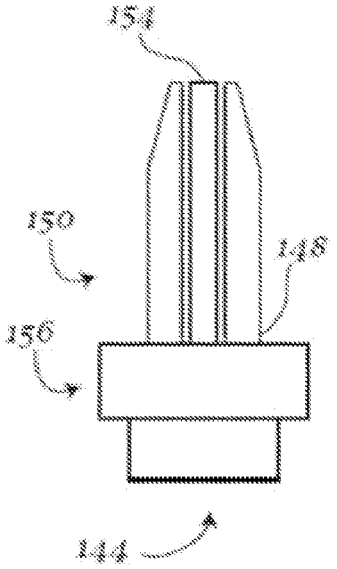

FIG. 3*a* may show an exemplary embodiment of a finger retaining nut guide.

Figure 3B:
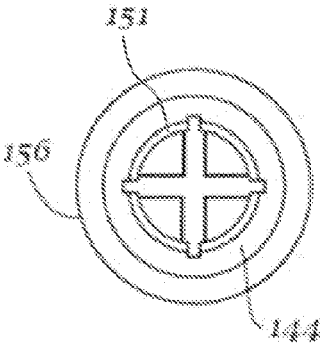

FIG. 3*b* may show an exemplary top view of a finger retaining nut.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage, or mode of operation.

FIG. 1 may show an exploded view of an exemplary embodiment of a black powder pellet loader 100. An end cap 102 may have an outside diameter and a receiving hole 104 protruding from a center of the end cap 102. Receiving hole 104 may have inside threads and outside threads thereon. A shoulder 106 may be formed on top of the receiving hole 104.

A main inner shaft 108 with a first end 110 may be received within the receiving hole 104 of the end cap 102. First end 110 of main inner shaft 108 may have threads configured couple to the inside threads of receiving hole 104. A second end 112 of the main inner shaft 108 may have threads configured to couple to threads on a first end 114 of a penetrating tube 116. A compression spring 118 may be received over the penetrating tube 116 and main inner shaft 108 such that a first end 120 of the compression spring 118 abuts the shoulder 106 of the end cap 102.

A main bottom right end tube 122 may be received over the main inner shaft 108, penetrating tube 116, and compression spring 118. A first end 124 of the main bottom right end tube 122 may be coupled to the outside threads of the receiving hole 104 of the end cap 102, and a second end 126 of the main bottom right end tube 122 may be slidably engaged with a first end 127 of a sliding raised rib tube 128. A thumb bracket 130 may be received over the sliding raised rib tube 128, and may be held on the sliding raised rib tube 128 by a snap ring 132.

A reducer adapter 134 may be coupled at a first end 136 to a second end 138 of the sliding raised rib tube 128. A second end 140 of the reducer adapter 134 may be coupled to a first end 142 of a finger retaining nut 144, the finger retaining nut 144 further having a hollow bore 146.

A first end 148 of each of a plurality of fingers 150 may be received through a second end 152 of the finger retaining nut 144, into hollow bore 146 and within a plurality of nubs 151 spaced equidistantly on an interior circumference of the finger retaining nut 144. The plurality of fingers 150 may each have a straight portion extending from the first end 148, and a downward bend proximate a tip end 154, such that the tip ends of the plurality of fingers 150 converge.

FIG. 2 may show an assembled view of black powder pellet loader 100. As shown in FIG. 2, when assembled, black powder pellet loader 100 has main bottom right end tube 122 assembled over the main inner shaft 108, penetrating tube 116, and compression spring 118 (not shown in FIG. 2), and threadably coupled to end cap 102. Main bottom right end tube is slidably coupled with sliding raised rib tube 128. Thumb bracket 130 is received over the sliding raised rib tube 128, and may be held on the sliding raised rib tube 128 by a snap ring 132. Reducer adapter 134 may be coupled to sliding raised rib tube 128. Finger retaining nut 144 may couple to reducer adapter 134, with plurality of fingers 150 received through finger retaining nut 144.

Referring generally to FIGS. 1-2, black powder pellet loader 100 may operate as follows. In order to receive black powder pellets within tip ends 154 of the plurality of fingers 150, tip ends 154 are movable from a closed position to an open position by sliding the thumb bracket 130 toward the main bottom right end tube 122 such that first end 127 of the sliding raised rib tube 128 is received within the second end 126 of the main bottom right end tube 122. This action may further cause reducer adapter 134, finger retaining nut 144 and the plurality of fingers 150 to move toward the main bottom right end tube 122, with each passing over second end 115 of penetrating tube 116 which may remain stationary relative to the sliding action.

Second end 115 of penetrating tube 116 may penetrate through the second end 136 of sliding raised rib tube 128, through reducer adapter 134 and hollow bore 146 and finger retaining nut 144 until second end 115 of penetrating tube 116 strikes the downward bend of each of the plurality of fingers 150. The downward bend of plurality of fingers 150 may continue to slide over the penetrating tube 116, which may force the tip ends 154 of the plurality of fingers 150 to diverge from the closed position to the open position.

Tip ends 154 may be maintained in the open position by sliding and holding thumb bracket 130 such that first end 127 of sliding raised rib tube 128 slides within main bottom right end tube 122 and strikes second end 121 of compression spring 118. Compression spring 118 may compress against shoulder 106 of end cap 102. When tip ends 154 are in the open position, a plurality of black powder pellets may be loaded between the plurality of fingers 150. When thumb bracket 130 is released, the compression spring 118 may release tension which may push sliding raised rib tube 128, reducer adapter 134 and finger retaining nut 144 back over second end 115 of penetrating tube 116, which may return tip ends 154 of the plurality of fingers 150 back to the closed position to firmly maintain one or more black powder pellets within the plurality of fingers 150.

Once one or more black powder pellets is loaded into black powder pellet loader 100, subsequently engaging thumb bracket 130 toward the main bottom right end tube 122 may move the tip ends 154 from the closed position to the open position to release at least one of the plurality of black powder pellets into the chamber of a firearm.

In some exemplary embodiments a stopper (not shown) may be arranged on an inside of the main bottom right end tube 122 proximate the second end 126. The stopper may be operable to stop the first end 127 of the sliding raised rib tube 128 from further sliding out of the second end 126 of the main bottom right end tube 122.

As shown in FIGS. 3*a* and 3*b*, a finger retaining nut guide 156 may be removably coupled over the finger retaining nut 144 and operable to guide the first ends 148 of the plurality of fingers 150 into the plurality of nubs 151 of the finger retaining nut 144.

As would be understood by a person of ordinary skill in the art, black powder pellet loader 100 may be sized to accommodate various sizes of black powder pellets. For example, in some exemplary embodiments, black powder pellet loader may be any of .31, .36, .44, or .45 caliber pellets.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. A black powder pellet loader for a revolver, comprising:

an end cap with an outside diameter and a receiving hole protruding from a center of the end cap, wherein a shoulder is formed on a top of the receiving hole, the receiving hole having inside and outside threads;

a main inner shaft with a first end received within the receiving hole of the end cap and coupled to the inside threads, and a second end coupled to a first end of a penetrating tube;

a compression spring received over the penetrating tube and main inner shaft such that a first end of the compression spring abuts the shoulder of the end cap;

a main bottom right end tube received over the main inner shaft, penetrating tube, and compression spring, a first end of the main bottom right end tube coupled to the outside threads of the receiving hole of the end cap, and a second end of the main bottom right end tube slidably engaged with a first end of a sliding raised rib tube;

a thumb bracket received over the sliding raised rib tube, and held on the sliding raised rib tube by a snap ring;

a reducer adapter having a first end coupled to a second end of the sliding raised rib tube and a second end coupled to a first end of a finger retaining nut, the reducer adapter having a hollow bore;

a plurality of fingers each having a first end and a tip end, the first end of the plurality of fingers received through a second end of the finger retaining nut and within a plurality of nubs spaced equidistantly on an interior circumference of the finger retaining nut, the plurality of fingers each having a straight portion extending from the first end, and a downward bend proximate the tip end, such that the tip ends of the plurality of fingers converge.

2. The black powder pellet loader of claim 1, wherein the tip ends of the plurality of fingers are movable from a closed position to an open position by sliding the thumb bracket toward the main bottom right end tube such that first end of the sliding raised rib tube is received within the second end of the main bottom right end tube, further causing reducer adapter, finger retaining nut and the plurality of fingers to move toward the main bottom right end tube and passing over penetrating tube until penetrating tube strikes the downward bend of each of the plurality of fingers, forcing the tip ends to diverge.

3. The black powder pellet loader of claim 2, wherein in the open position, a plurality of black powder pellets may be loaded between the plurality of fingers.

4. The black powder pellet loader of claim 3, wherein the plurality of black powder pellets are at least one of 31, 36, 44, and 45 caliber pellets.

5. The black powder pellet loader of claim 3, wherein releasing the thumb bracket returns the tip ends to the closed position.

6. The black powder pellet loader of claim 1, further comprising a nut retaining finger guide removably coupled over the finger retaining nut and operable to guide the first ends of the plurality of fingers into the plurality of nubs.

7. The black powder pellet loader of claim 5, wherein subsequently engaging the thumb bracket toward the main bottom right end tube may move the tip ends from the closed position to the open position to release at least one of the plurality of black powder pellets.

* * * * *